United States Patent [19]

Skuthan

[11] Patent Number: 4,641,772

[45] Date of Patent: Feb. 10, 1987

[54] ANTI-JAMMING NOSE PLATE FOR DRIVING APPARATUS FOR FASTENERS

[75] Inventor: Erich Skuthan, Holzmaden, Fed. Rep. of Germany

[73] Assignee: Karl M. Reich Maschinenfabrik GmbH, Nuertingen, Fed. Rep. of Germany

[21] Appl. No.: 703,222

[22] Filed: Feb. 19, 1985

[30] Foreign Application Priority Data

Feb. 10, 1984 [DE] Fed. Rep. of Germany ..... 3404755

[51] Int. Cl.[4] ..... B25C 1/00; B25C 5/00; B25F 5/00

[52] U.S. Cl. ..... 227/123

[58] Field of Search ..... 227/120, 123

[56] References Cited

U.S. PATENT DOCUMENTS

| | | | |
|---|---|---|---|
| 2,668,290 | 2/1954 | Heller | 227/132 |
| 3,063,421 | 11/1962 | Fisher | 227/123 X |
| 3,099,012 | 7/1963 | Wandel | 227/123 |
| 3,215,324 | 11/1965 | Dorney | 227/123 |
| 3,347,439 | 10/1967 | Doherty | 227/123 X |
| 3,853,257 | 12/1974 | Perkins | 227/123 |
| 4,139,137 | 2/1979 | Gupta | 227/123 |
| 4,436,236 | 3/1984 | Jobe | 227/123 |

*Primary Examiner*—Robert L. Spruill
*Assistant Examiner*—Taylor J. Ross
*Attorney, Agent, or Firm*—W. G. Fasse; D. H. Kane, Jr.

[57] ABSTRACT

A driving device for securing fasteners (7) such as nails, staples, etc., which are stored in a magazine (6) to be supplied to an ejection channel (5) provided with an opening (8) closed by a spring biased nose plate (9) elastically held by a spring (14) against the opening (8) of the ejection channel (5) in the nose portion (4) on the side opposite the magazine (6). When jamming occurs between a driving plunger (2) and fastener (7), the nose plate (9) lifts itself against the bias of the spring, whereby jamming is frequently avoided automatically. If jamming occurs nevertheless, the nose plate (9) may be completely removed from the opening (8) of the ejection channel (5) so that the jamming may easily be cleared. Potential jamming situations are often avoided since the nose plate (9) may deflect to partially open the ejection channel (5).

9 Claims, 4 Drawing Figures

ANTI-JAMMING NOSE PLATE FOR DRIVING APPARATUS FOR FASTENERS

FIELD OF THE INVENTION

The invention relates to a driving apparatus for fasteners such as nails, staples, pins, and the like. Such nailers, staplers, and the like have a nose portion with an ejection channel, attached to a housing. An impact driver driven by an impact piston is slidably supported in the ejection channel. A magazine for storing and supplying the fasteners is attached to the nose portion. A movable nose plate for covering an opening of the ejection channel is arranged on the nose portion on the side opposite the magazine.

DESCRIPTION OF THE PRIOR ART

It is to be understood, that in the following disclosure the term "fasteners" refers, for instance, to nails, staples, T-nails, pins, etc.

A driving device of the above described type is known from German Patent Publication (DE-OS) No. 2,724,220, corresponding to U.S. Ser. No. 758,493, filed in the United States on Jan. 11, 1977, now U.S. Pat. No. 4,139,137 (Gupta) in which a nose plate is attached to the nose portion by means of a bellcrank or toggle lever closure. In such a structure, if jamming occurs between a fastener and the driver in the ejection channel, the nose plate may be lifted away from the guide foot by opening the toggle lever closure. Thus, the ejection channel is exposed and the jammed fastener may be removed.

Such a toggle lever closure is, however, inflexible and unyielding, so that the driver as well as the inner walls of the ejection channel may become damaged in the event of jamming. The driver strikes the fastener with great impact energy, whereby in the event of jamming a wedging action may occur, thus considerable damage to the driving device may result. If deviations in thickness exist in the fasteners, which is quite possible considering that such fasteners are produced in large numbers by a stamping and bending process, jamming between the driver and fasteners may be caused simply by these thickness variations, due to the rigid nose plate. Any such jamming would halt the normal working operation and necessitate removal of the jammed fastener.

OBJECTS OF THE INVENTION

In view of the above, it is the aim of the invention to achieve the following objects singly or in combination:

to provide a driving device with a nose plate which "gives" or deflects slightly without completely exposing the ejection channel, in order to avoid jamming, for example, due to an overly thick fastener;

to avoid damaging the driver and/or the ejection channel;

to provide a driving device with a nose plate which completely exposes the ejection channel in the event of a jamming between the driver and a fastener, in order to remove or clear the jammed elements; and to allow such a nose plate to be quickly and completely removed and quickly replaced again manually in a simple manner in order to facilitate the removal of a jammed fastener or fasteners.

SUMMARY OF THE INVENTION

These objects have been achieved in a driving device according to the invention, in which a spring is provided for elastically pressing the nose plate against a window of the nose portion. Furthermore, the nose portion comprises stop shoulders which engage stop surfaces of the nose plate in its closed position, so that a lengthwise sliding displacement of the nose plate is prevented.

These features of the invention have the advantage, that the nose plate yields or deflects elastically when a fastener which is too thick is introduced into the ejection channel. Thus, the fastener will normally not become jammed, and the normal working operation may continue without interruption.

However, in the event of an actual jamming, the nose plate according to the invention will be lifted away from and over the stop shoulder of the nose portion, so that the spring loses tension and the opening of the ejection channel is completely exposed. Thus, a jammed or bent fastener may easily be removed. The driver and the parts of the ejection channel remain undamaged by the jamming due to the yielding of the nose plate.

Through the use of a tiltable, preshaped spring having a bail and shanks in a U-shape, the nose plate may be completely, easily and quickly removed from the nose portion for removing a jamming situation. Furthermore, it is also simple to completely remove the spring itself from the nose portion, for instance to replace it.

In order to remove the nose plate, it is also possible to relax the spring by means of an auxiliary tool, such as a screwdriver for instance. The tool, if it is a screwdriver or the like, may be inserted into grooves extending crosswise in the front face of the nose plate in order to pry the spring away. The nose plate may also easily be reinserted and retensioned, in that the ball of the spring may be pushed with an auxiliary tool over a cocking or loading wedge surface provided on the nose plate.

In order to prevent the nose plate from falling off the driving device after relaxing the holding spring, a tiltable catch pawl is provided on the nose portion. The pawl securely holds the nose plate free of the spring clamping force.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
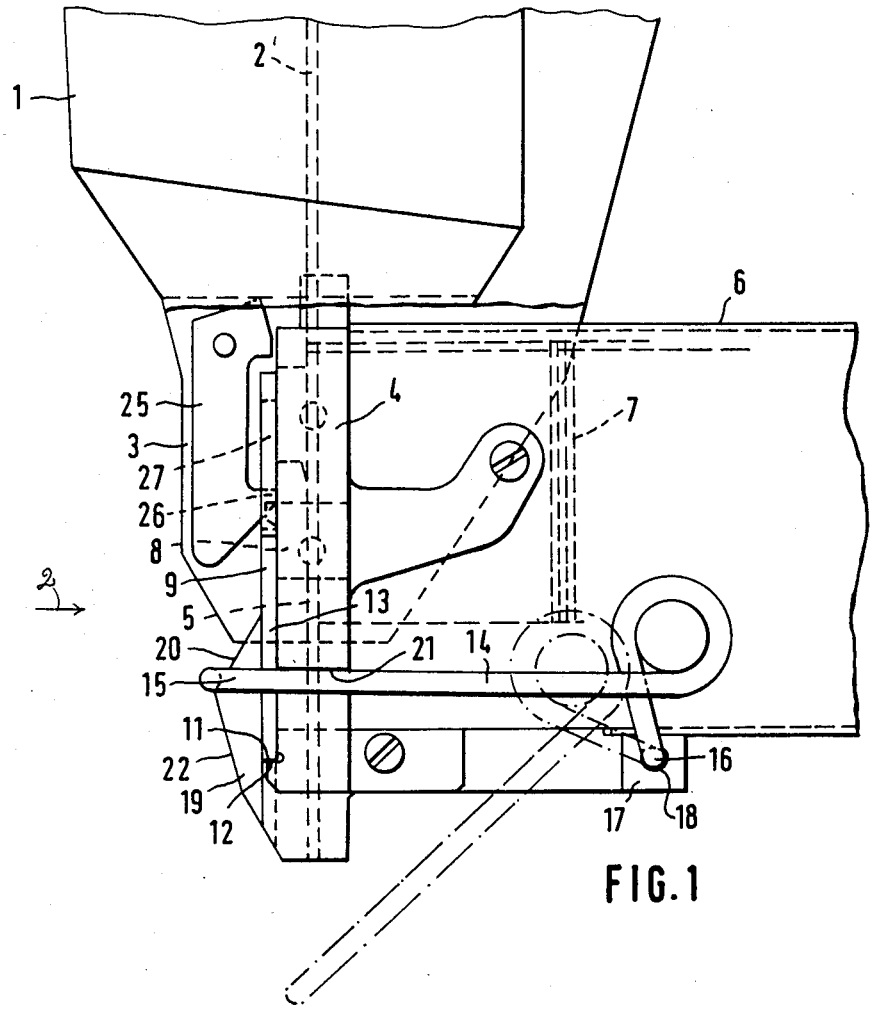
FIG. 1 is a side view of the lower part of a driving device or apparatus, with the housing partially broken away.

In the driving device partially shown in FIG. 1, an impact piston not shown is slidably arranged in a housing 1, and is connected to a driver 2'. A nose portion 4, comprising an ejection channel 5 which is open downwardly, is attached to the side walls 3 of the housing 1. The driver 2' moves up or down in the channel 5.

Figure 2:
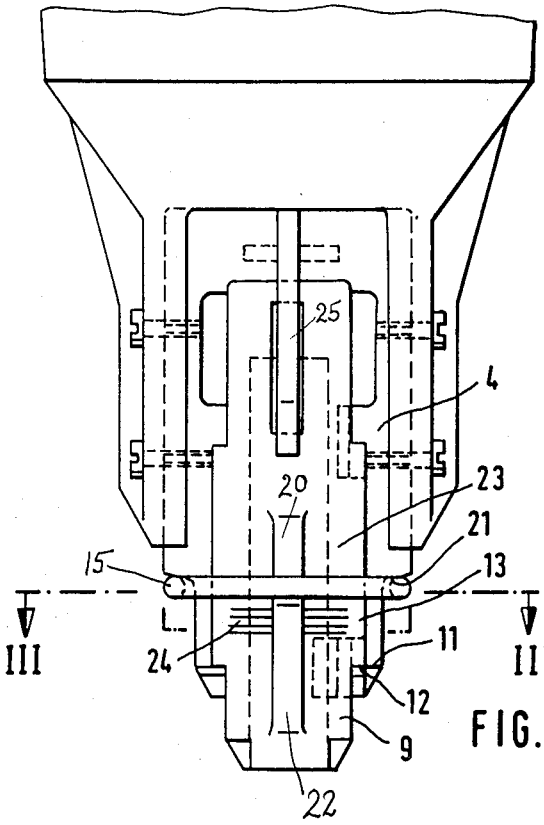
FIG. 2 is a front view of the lower part of a driving apparatus as viewed in the direction of the arrow 2 in FIG. 1.
Figure 3:
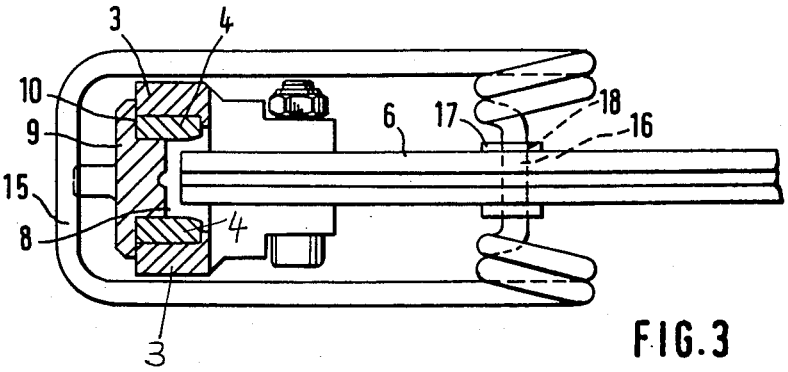
FIG. 3 is a section along line III—III in FIG. 2.

A magazine 6 is attached to the nose portion 4 for storing and supplying fasteners 7, for example staples, to the ejection channel 5. A nose plate 9 which covers a window 8 in the side of the nose portion 4 provides access substantially to the entire lower end of the ejection channel 5. The window 8 is arranged on the side of the nose portion 4 opposite the magazine 6. The nose plate 9 presses against front surfaces 10 of the nose portion 4, see FIG. 3. Further, support of the nose plate 9 is achieved in that stop surfaces 12 of lugs 13 of the nose plate 9 rest against shoulders 11 arranged perpendicular to the ejection channel 5 on the nose portion 4, see FIG. 2.

A shaped spring 14 serves to elastically hold or clamp the nose plate 9 against the nose portion 4, whereby normally the stop surfaces 12 engage the shoulders 11. The spring 14 comprises a U-shaped bail 15 and pins 16 at its free ends. The pins 16 are inserted into holes 18 bored into a support block 17 attached to the magazine 6. Thus, the spring 14 simultaneously performs the functions of holding and of elastically biasing the nose plate 9.

The nose plate 9 comprises a nose 19 having a tensioning wedge surface 20 tilted toward the ejection channel 5. In the tensioned state of the clamping spring 14, the bail 15 of the spring 14 rests against the tensioning wedge surfaces or ramp 20. To prevent the spring 14 from tilting or swinging in its tensioned state in a clockwise direction as seen in FIG. 1, stop shoulders 21 are provided on the nose portion 4, against which the spring 14 pushes in an upward direction.

The nose 19 further comprises a cocking or loading wedge surface 22 tilted away from the ejection channel 5. In order to cock or tension the bail 15 of the spring 14 the latter may be pushed over the loading wedge surface 22 from the open untensioned position shown by dash-dotted lines in FIG. 1, to the closed cocked position shown by solid lines in FIG. 1. In order to facilitate this cocking with ease, horizontal grooves 24 are provided in the front surface 23 of the nose plate 9. An auxiliary tool, for instance a screwdriver, may be inserted in these grooves 24 for prying the bail 15 into the tensioned or cocked position, see FIG. 2.

Furthermore, a catch pawl 25 is tiltably attached to the nose portion 4. A hook 26 of the catch pawl 25 engages a slot 27 in the nose portion 9 to hold the latter against falling down when the clamping force of the spring 14 is released for any reason.

Figure 4:
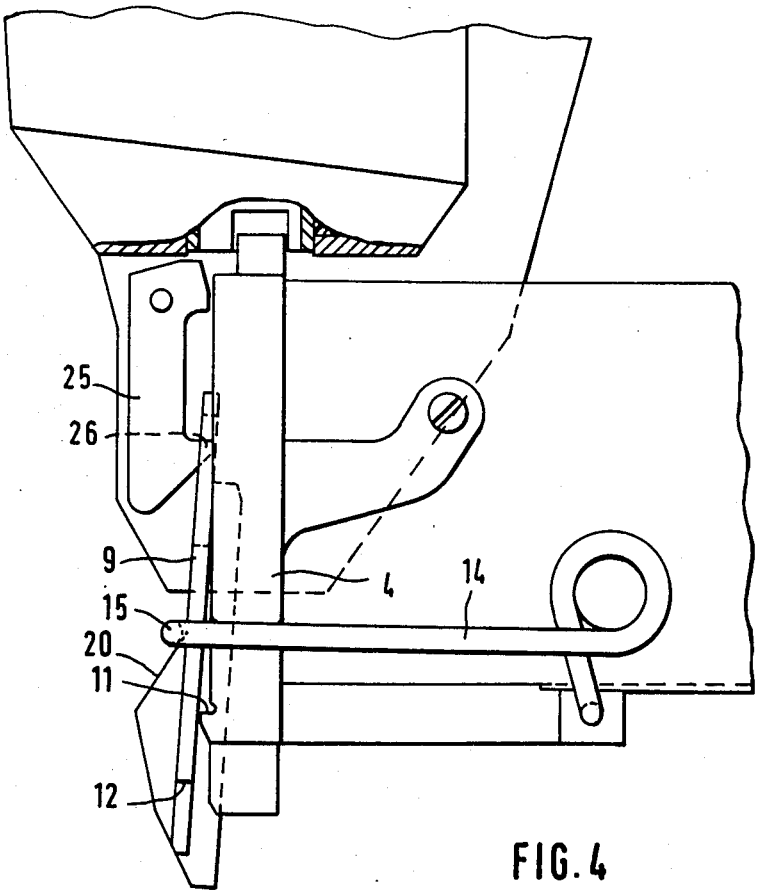
FIG. 4 is a view of a driving device similar to FIG. 1, however, with the nose plate shown in a yielding position.

If, due to a jamming as shown in FIG. 4, the nose plate 9 is lifted away from the nose portion 4 against the bias of the spring 14, then the stop surface 12 of the nose plate 9 is pushed away from the shoulder 11 of the nose portion 4. Then the nose plate 9 slides downwardly due to a force component exerted by the bail 15 of the spring 14 acting on the tensioning wedge surface 20, whereby, the ejection channel 5 is partially opened. However, the nose plate 9 is prevented from falling off by the hook 26 of the catch pawl 25. The nose plate 9 may easily be completely removed if the catch pawl 25 is manually disengaged and tilted away from the nose plate 9. Thus, the ejection channel 5 is completely exposed, and the spring 14 tilts downwardly into the open position shown by dash-dotted lines in FIG. 1.

In order to replace and tension the nose plate 9, it may first be set into the nose portion 4, and then the spring 14 may be tensioned by pushing it over the cocking wedge surface 22 with an auxiliary tool. Alternately, it is also possible to place the nose plate 9 and spring 14 into the opening position shown in FIG. 4, and then to push the nose plate 9 upwards into its closed position by pushing the driving device down against any appropriate surface.

Although the invention has been described with reference to specific example embodiments, it is to be understood, that it is intended to cover all modifications and equivalents within the scope of the appended claims.

I claim:

1. An apparatus for driving fasteners, comprising housing means, a nose portion (4) with an ejection channel (5) for said fasteners attached to said housing means, a driving means slidably supported in said ejection channel, a magazine attached to said nose portion (4) for storing and supplying said fasteners into said ejection channel, a lateral access opening in said nose portion (4) for providing access substantially to the entire lower end of said ejection channel, a movable nose plate (9) for covering said lateral access opening of said ejection channel, spring means secured to said apparatus for biasing said nose plate into a window closing position, whereby said nose plate is pressed against said opening of said nose portion in an elastically yielding manner, said nose portion comprising stop shoulder means, said nose plate comprising a stop surface engaging said stop shoulder means in the window closing position of said nose plate, whereby a lengthwise sliding displacement of said nose plate is prevented, and wherein said nose plate comprises a spring tensioning wedge surface angled toward said ejection channel and a spring cocking wedge surface angled away from said ejection channel, said wedge surfaces forming a ridge which provides a first spring stop (22), and a second spring stop (21) on said nose portion, said spring means being mounted in such a position on said apparatus that said spring means is received between said spring stops (21, 22) in a biased position, whereby said spring means simultaneously holds and biases said nose plate.

2. The driving apparatus of claim 1, wherein said stop shoulder means of said nose portion extend perpendicularly to said ejection channel.

3. The apparatus of claim 1, wherein said spring means comprises a preshaped configuration including a bail which engages said nose plate in its window closing position.

4. The apparatus of claim 1, comprising journal hole means, and wherein said spring means comprise journal pin means tiltably and removably received in said journal hole means for anchoring and journaling said journal pin means of said spring means in said apparatus.

5. The driving apparatus of claim 1, wherein said spring means comprises a bail for movement over said cocking wedge surface into said biased position.

6. The driving apparatus of claim 1, wherein said nose plate comprises grooves in the outer surface of said nose plate near said cocking wedge surface, for bracing an auxiliary tool in said grooves for cocking said spring means.

7. The driving apparatus of claim 1, comprising a catch pawl (25) movably attached to said nose portion, a recess (27) in said nose plate for engagement of said nose plate by said catch pawl so that said nose plate is held in place on said nose portion even in an open position.

8. The apparatus of claim 1, wherein said opening for providing access to said ejection channel is located in said nose portion opposite said magazine.

9. The apparatus of claim 1, wherein said spring means comprise two helical windings and a nose plate biasing bail, one winding being located at each end of said bail and journal pin means intermediate said windings, said apparatus further comprising a support block attached to said nose portion, said support block having journal hole means therein in which said journal pin means are removably and tiltably received.

* * * * *